US006378177B1

(12) United States Patent
Athans et al.

(10) Patent No.: US 6,378,177 B1
(45) Date of Patent: Apr. 30, 2002

(54) TOP-FILLED TAMPER-EVIDENT PACKAGE

(75) Inventors: John D. Athans, Victor; Craig E. Cappel, Pittsford; Michael W. McManus, Marion, all of NY (US)

(73) Assignee: Pactiv Corporation, Lake Forest, IL (US)

( * ) Notice: Subject to any disclaimer, the term of this patent is extended or adjusted under 35 U.S.C. 154(b) by 78 days.

(21) Appl. No.: 09/609,939

(22) Filed: Jun. 28, 2000

(51) Int. Cl.[7] ..... A44B 19/00; B65D 33/20

(52) U.S. Cl. ..... 24/585.12; 24/415; 24/399; 383/63

(58) Field of Search ..... 24/585.12, 399, 24/400, 412, 415; 383/63–66, 203, 204, 207, 209

(56) References Cited

U.S. PATENT DOCUMENTS 3,991,801 A * 11/1976 Ausnit ..... 24/585.12 X
4,925,316 A 5/1990 Van Erden et al.
5,211,482 A 5/1993 Tilman
5,911,508 A * 6/1999 Dobreski et al. ..... 383/63 X
5,964,532 A 10/1999 St. Phillips et al.
6,010,244 A * 1/2000 Dobreski et al. ..... 383/63
6,088,887 A * 7/2000 Bois ..... 24/399
6,115,892 A * 9/2000 Malin et al. ..... 24/585.12
6,257,763 B1 * 7/2001 Stolmeier et al. ..... 383/63 X

* cited by examiner

*Primary Examiner*—Robert J. Sandy

(57) ABSTRACT

A fastener for a top-filled tamper-evident reclosable plastic package is disclosed. The package includes first and second opposing panels joined along a pair of sides and a bottom bridging said sides. The fastener includes first and second opposing tracks along a top of the package. The first and second tracks include respective first and second interlocking profiles and respective first and second fins extending from the respective first and second profiles. The first and second fins are joined to each other at their respective lower ends. A preferential area of weakness is disposed along or near the juncture of the first and second fins. While the fastener is attached to the first panel, the fastener initially is at least partially unattached to the second panel so as to allow the package to be filled with a product via a fill opening between the fastener and the second panel. After filling the package with the product, the fill opening is sealed. The fastener includes special structure added proximate the fins to prevent the fins from being deformed, being stuck to each other, or being accidentally sealed to each other while sealing the fill opening.

22 Claims, 3 Drawing Sheets

28
30
32
24
10
26
28
16
12
14
16
22
20

TOP-FILLED TAMPER-EVIDENT PACKAGE

FIELD OF THE INVENTION

The present invention generally relates to packages to be filled with a product on a form, fill, and seal machine and, more particularly, to a reclosable package filled through its top on a form, fill, and seal machine.

BACKGROUND OF THE INVENTION

A typical reclosable package includes first and second opposing panels joined to each other along a pair of sides and a bottom bridging the pair of sides. A reclosable fastener extends along a package top disposed opposite the bottom. The fastener generally includes first and second opposing tracks. The first track includes a first profile, while the second track includes a second profile adapted to releasably interlock with the first profile. The first and second tracks are thermally fused to, or integrally formed with, the respective first and second panels. To open and close the fastener, the package may be provided with a slider mounted to the fastener.

If reclosable packages of the foregoing type are to be prepackaged with a product and then sold in a store, the packages are typically prepared on a horizontal or vertical form, fill, and seal machine. In the form, fill, and seal machine, the package is first formed into the shape of a pouch having a fill opening at either the top or the bottom. If the fill opening is disposed at the bottom, then the top is sealed prior to filling the package. Similarly, if the fill opening is disposed at the top, then the bottom is sealed prior to filling the package. Next, the package is filled with the product via the fill opening. Finally, the fill opening is sealed shut to fully enclose the product within the package. If the product delivered to the package includes food, then the fill opening is typically provided at the package bottom and a tamper-evident feature is provided along the top. The tamper-evident feature indicates to a consumer whether or not the package has been tampered with prior to purchase.

Some reclosable packages include a gusset along the bottom which expands in response to filling the package with a product. The gusset is advantageous because it increases the volume of product that can be contained in the package and, when the gusset expands, it allows the package to stand up on a store shelf. The stand-up package obviates the use of additional features such as headers with holes for hanging the package from a hook or post. The bottom gusset, however, makes it less practical to provide a fill opening at the bottom because most of the product resides in the gusset.

As a result, it is desirable to provide a fill-through-the-top reclosable package. One example of such a package is disclosed in U.S. Pat. No. 6,071,011 to Thomas et al. The Thomas patent discloses a fill-through-the-top reclosable package including first and second opposing body panels joined to each other along a pair of sides and a bottom bridging the pair of sides. A fastener, including first and second opposing tracks, extends along a package top disposed opposite the bottom. The first and second opposing tracks include respective first and second interlocking profiles and respective first and second fins extending from the respective first and second profiles. To provide tamper evidence, the first and second fins are joined to each other along a preferential line of weakness. While the first fin is attached to the first panel, the second fin is initially at least partially unattached to the second panel so as to provide a fill opening between the second fin and the second panel.

After the package is filled with a product via the fill opening, a sealer generates a seal between the second fin and the second panel to seal the fill opening. Unless precise operational control is maintained over such variables as the temperature, pressure, and dwell time of the sealer, the sealer could transfer excessive heat to the fins during the sealing process. Such excessive heat could deform the fins, cause the fins to stick to each other, or even accidentally seal the fins to each other. This, in turn, could make it difficult for the consumer to properly open the sealed package.

SUMMARY OF THE INVENTION

To overcome the potential shortcomings noted above, the present invention is directed to a fastener for a top-filled tamper-evident reclosable plastic package. The package includes first and second opposing panels joined along a pair of sides and a bottom bridging said sides. The fastener includes first and second opposing tracks along a top of the package. The first and second tracks include respective first and second interlocking profiles and respective first and second fins extending from the respective first and second profiles. The first and second fins are joined to each other at their respective lower ends. A preferential area of weakness is disposed along or near the juncture of the first and second fins. While the fastener is attached to the first panel, the fastener initially is at least partially unattached to the second panel so as to allow the package to be filled with a product via a fill opening between the fastener and the second panel. After filling the package with the product, the fill opening is sealed. In accordance with the present invention, the fastener includes special structure added proximate the fins to prevent the fins from being deformed, being stuck to each other, or being accidentally sealed to each other while sealing the fill opening.

In one embodiment, the special structure includes an additional fin extending from the second track and disposed generally alongside the second fin. The additional fin initially is at least partially unattached to the second panel while the first fin is attached to the first panel so as to allow the package to be filled with a product via a fill opening between the fastener and the second panel. After the package is filled with the product, the additional fin is attached to the second panel to seal the fill opening. This embodiment may be slightly modified to include another additional fin extending from the first track and disposed generally alongside the first fin. In this case, instead of attaching the first fin directly to the first panel, the another additional fin is attached to the first panel.

In another embodiment, the special structure includes a fin extension extending from the lower end of the second fin. The second fin and the fin extension initially are at least partially unattached to the second panel while the first fin is attached to the first panel so as to allow the package to be filled with a product via a fill opening between the fastener and the second panel. After the package is filled with the product, the fin extension is attached to the second panel to seal the fill opening. This embodiment may be slightly modified to include another fin extension extending from the lower end of the first fin.

BRIEF DESCRIPTION OF THE DRAWINGS

Other objects and advantages of the invention will become apparent upon reading the following detailed description and upon reference to the drawings in which.

Figure 1:
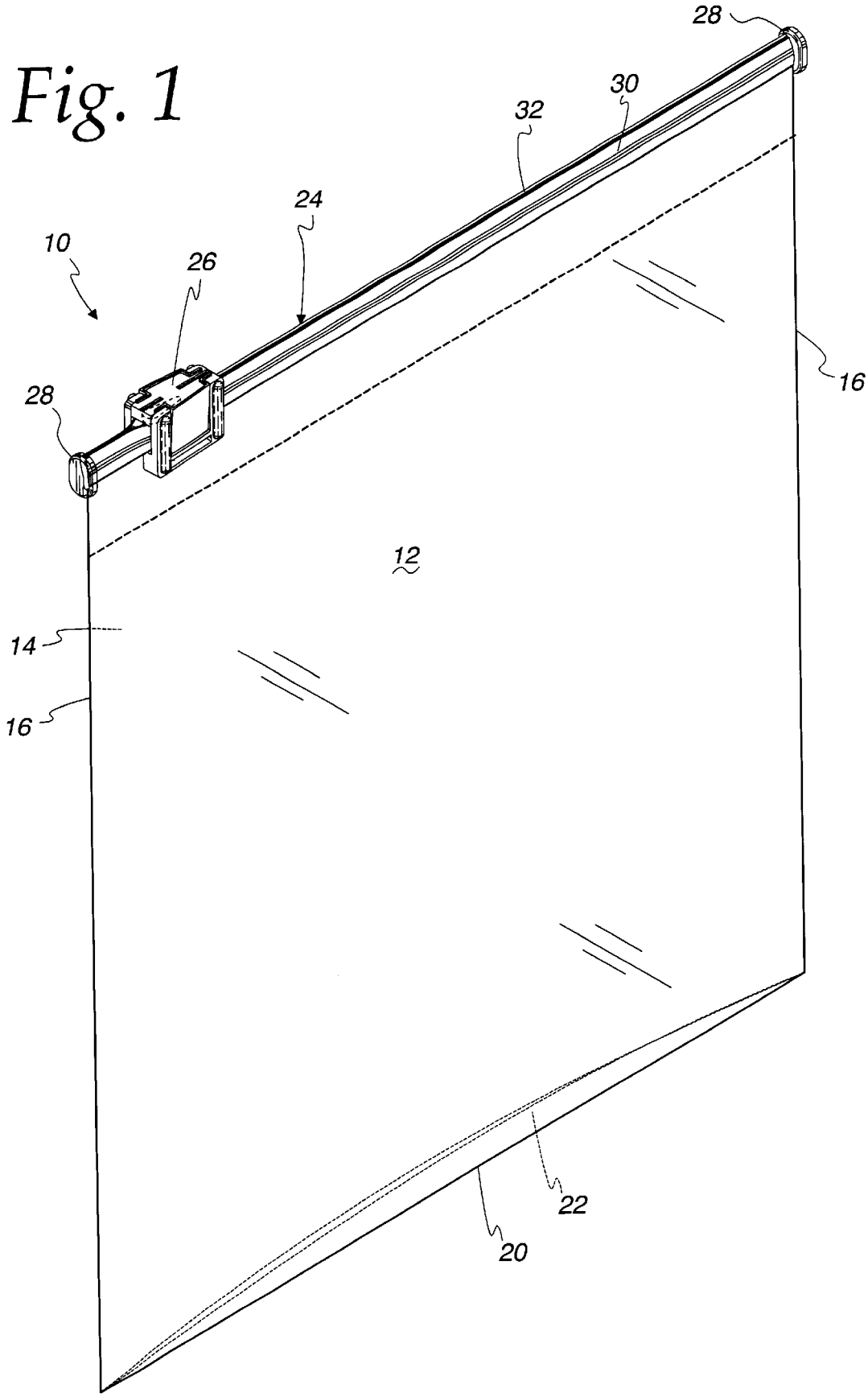
FIG. 1 is an isometric view of a top-filled tamper-evident reclosable package embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Turning now to the drawings, FIG. 1 depicts a top-filled tamper-evident reclosable package 10. The package 10 includes first and second opposing body panels 12 and 14 joined to each other along a pair of sides 16 and a bottom 20 bridging the pair of sides 16. The bottom 20 optionally includes a gusset 22 that expands in response to filling the package with a product. The gusset 22 is advantageous because it increases the volume of product that can be contained in the package 10 and, when the gusset 22 expands, it allows the package 10 to stand up on a store shelf. The stand-up package 10 obviates the use of additional features such as headers with holes for hanging the package from a hook or post. The package 10 includes a reclosable fastener 24 extending along a package top disposed opposite the gusseted bottom 20.

To open and close the fastener 24, the package 10 is optionally provided with a slider 26 mounted to the fastener 24. The slider 26 progressively disengages the fastener's profiles as the slider is moved along the fastener 24 in an opening direction, and progressively interlocks the fastener's profiles as the slider is moved along the fastener 24 in a closing direction. To accommodate the slider 26 and make it difficult to open the fastener 24 without using the slider, the fastener 24 is preferably free of pull flanges extending upwardly from the fastener's profiles. To stop movement of the slider 26 near the sides 16 of the package 10 and thereby prevent the slider 26 from sliding off the end of the fastener 24, a pair of end terminations 28 are mounted to the fastener 24 near the respective sides 16 of the package 10. One of the end terminations 28 stops movement of the slider 26 in the opening direction, while the other end termination 28 stops movement of the slider 26 in the closing direction. The end terminations 28 may be a separate element attached to the fastener 24, as shown in FIG. 1, or may be integrally formed with the fastener 24.

Figure 2:
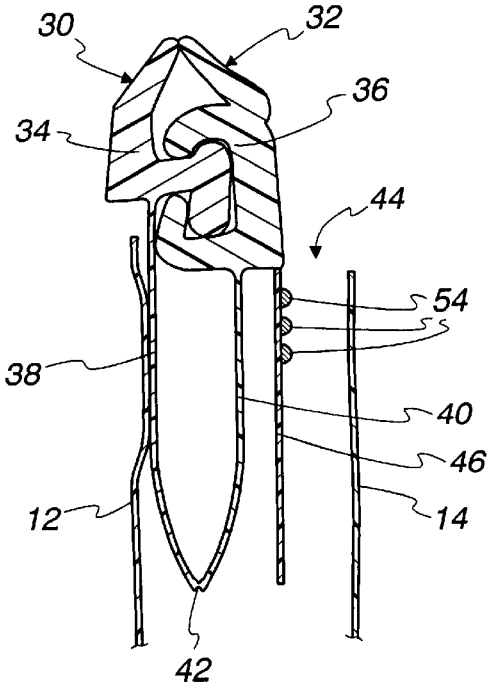
FIG. 2 is a cross-sectional view of the top of the package prior to being filled, in accordance with a first embodiment of the present invention.
Figure 3:
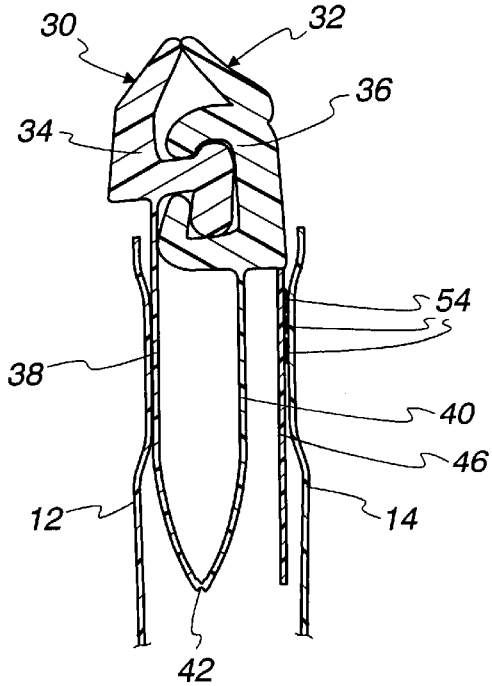
FIG. 3 is a cross-sectional view of the top of the package after being filled and sealed, in accordance with the first embodiment of the present invention.

Referring to FIGS. 2 and 3, the fastener 24 includes first and second opposing tracks 30 and 32 along a top of the package. The tracks 30 and 32 include respective first and second interlocking profiles 34 and 36 and respective first and second fins 38 and 40 extending from the respective profiles 34 and 36. The profile 34 preferably forms a rib, and the profile 36 preferably forms a groove adapted to receive the rib. To provide tamper evidence, the fins 38 and 40 are joined to each other at their respective lower ends to effectively create a single fin comprised of the fins 38 and 40. A preferential area of weakness 42 is disposed along or near the juncture of the fins 38 and 40. The preferential area of weakness 42 may, for example, be a scored line, a perforated line, a thinned die line, or a tear strip.

The fastener 24 is attached to the panel 12 by thermal fusion. At the same time, the fastener 24 initially is attached to the panel 14 by thermal fusion only along the sides 16 (see FIG. 1) of the package and initially is unattached to the panel 14 in the region between the sides. This allows the package to be filled with a product such as food via a fill opening 44 between the fastener 24 and the panel 14. After filling the package with the product, the fill opening 44 is sealed. In accordance with the present invention, the fastener 24 includes special structure added proximate the fins 38 and 40 to prevent the fins from being deformed, being stuck to each other, or being accidentally sealed to each other while sealing the fill opening 44.

In a first embodiment depicted in FIGS. 2 and 3, the special structure includes an additional fin 46 extending from the profile 36 and disposed generally alongside the fin 40. While the fin 38 is attached to the panel 12 by thermal fusion, the additional fin 46 initially is attached to the panel 14 by thermal fusion only along the sides 16 (see FIG. 1) so as to allow the package to be filled with a product via the fill opening 44 between the fin 46 and the panel 14. As shown in FIG. 3, after the package is filled with the product, the additional fin 46 is attached to the panel 14 by thermal fusion to seal the fill opening. The additional fin 46 may also fuse to the fin 40 during the sealing process. A plurality of narrow low-temperature sealant ribs 54 (see FIG. 2) are optionally disposed along an outer surface of the additional fin 46 to facilitate connecting the additional fin 46 to the panel 14. The breakable line of weakness 42 is located at the juncture of the fins 38 and 40. A consumer opens the package by moving the slider to the open position to disengage the profiles 34 and 36 and then pulling the fins 38 and 40 apart until the breakable line of weakness 42 is ruptured.

Figure 4:
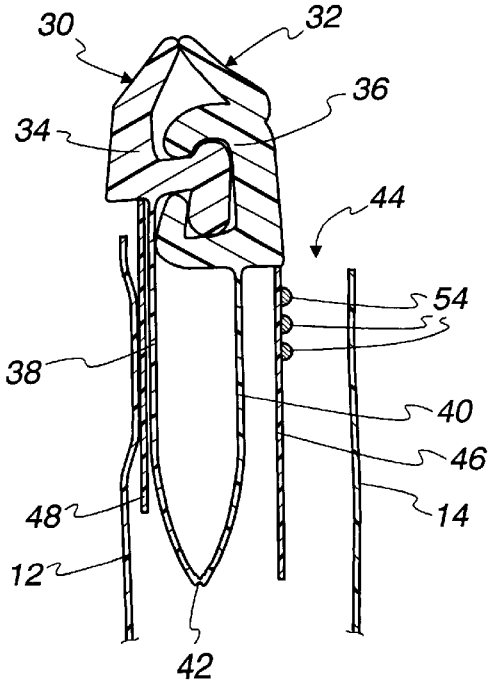
FIG. 4 is a cross-sectional view of the top of the package prior to being filled, in accordance with a second embodiment of the present invention.
Figure 5:
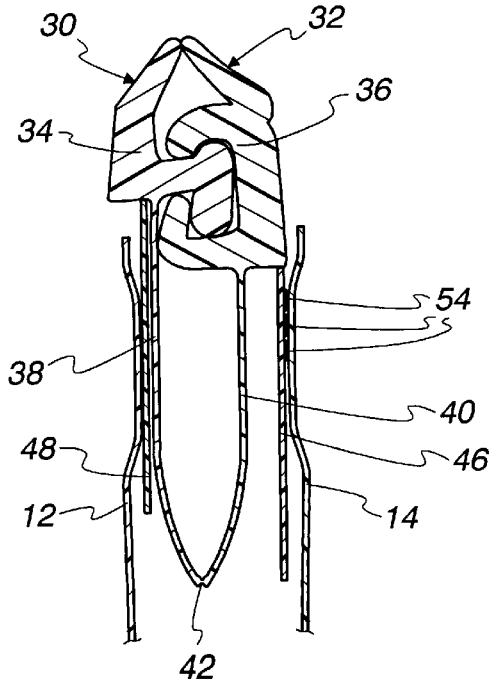
FIG. 5 is a cross-sectional view of the top of the package after being filled and sealed, in accordance with the second embodiment of the present invention.

In a second embodiment depicted in FIGS. 4 and 5, the embodiment of FIGS. 2 and 3 is slightly modified to include another additional fin 48 extending from the profile 34 and disposed generally alongside the fin 38. In this case, instead of attaching the fin 38 directly to the panel 12 by thermal fusion, the another additional fin 48 is attached to the panel 12 by thermal fusion. The another additional fin 48 may also fuse to the fin 38 during the sealing process.

Figure 6:
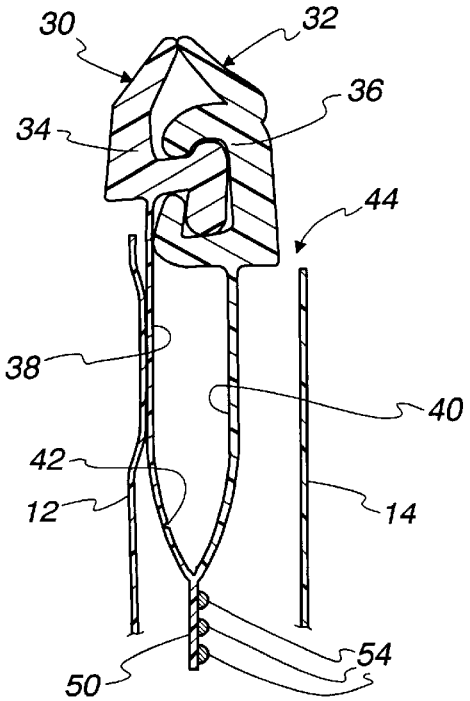
FIG. 6 is a cross-sectional view of the top of the package prior to being filled, in accordance with a third embodiment of the present invention.
Figure 7:
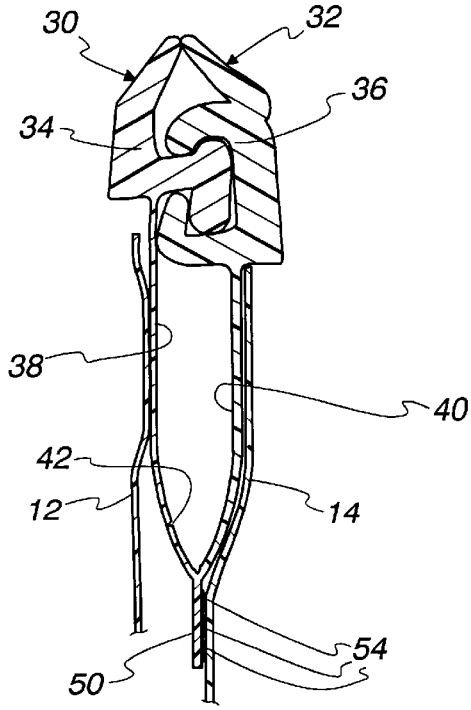
FIG. 7 is a cross-sectional view of the top of the package after being filled and scaled, in accordance with the third embodiment of the present invention.

In a third embodiment depicted in FIGS. 6 and 7, the special structure includes a fin extension 50 extending from the lower end of the fin 40. The fins 38 and 40 and the fin extension 50 define a "Y" cross-sectional configuration. While the fin 38 is attached to the panel 12 by thermal fusion, the fin 40 and the fin extension 50 initially are attached to the panel 14 by thermal fusion only along the sides 16 (see FIG. 1) so as to allow the package to be filled with a product via the fill opening 44 between the fastener 24 and the panel 14. As shown in FIG. 6, after the package is filled with the product, the fin extension 50 is attached to the panel 14 by thermal fusion to seal the fill opening. A plurality of narrow low-temperature sealant ribs 54 are optionally disposed along an outer surface of the fin extension 50 to facilitate connecting the fin extension 50 to the panel 14. Also, the fin 40 and the fin extension 50 may be thicker than the fin 38. The breakable line of weakness 42 is located along the fin 38 near the juncture of the fins 38 and 40. A consumer opens the package by moving the slider to the open position to disengage the profiles 34 and 36 and then pulling the fins 38 and 40 apart until the breakable line of weakness 42 is ruptured.

Figure 8:
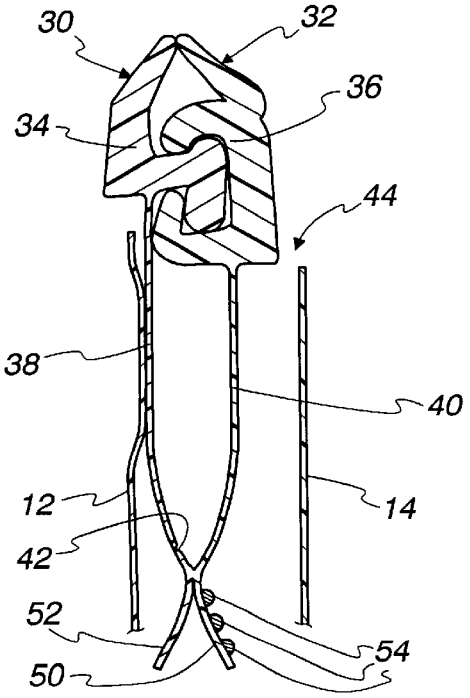
FIG. 8 is a cross-sectional view of the top of the package prior to being filled, in accordance with a fourth embodiment of the present invention.
Figure 9:
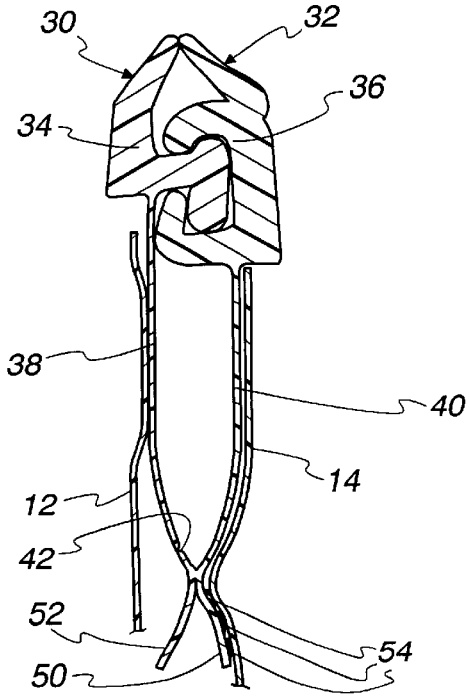
FIG. 9 is a cross-sectional view of the top of the package after being filled and sealed, in accordance with the fourth embodiment of the present invention.

In a fourth embodiment depicted in FIGS. 8 and 9, the embodiment of FIGS. 6 and 7 is slightly modified to include another fin extension 52 extending from the lower end of the fin 38. The fins 38 and 40 and the fin extensions 50 and 52 define an "X" cross-sectional configuration. A plurality of narrow low-temperature sealant ribs 54 are optionally disposed along an outer surface of the fin extension 50 to facilitate connecting the fin extension 50 to the panel 14. The fin extensions 50 and 52 may be comprised of different materials such that the fin extension 50 will seal to the panel 14 at a lower temperature than required to seal the fin extension 52 to the panel 12.

The package 10 may be composed of various plastic polymers, copolymers, coextrusions and/or laminations. The panels 12 and 14 are preferably comprised of mono-layer or multi-layer combinations of: polyethylene (high, medium, low, linear low, and/or ultra low density polymers including metallocene); polypropylene (oriented and/or biaxially oriented); ethylene vinyl acetate; nylon (oriented and/or biaxially oriented); polyethylene terephthalate (oriented and/or biaxially oriented); polyvinyl chloride; ethylene vinyl alcohol (EVOH); polyvinylidene chloride (PVDC); polyvinyl alcohol (PVOH); polystyrene; foil and/or metalization; and paper. The slider 26 and end terminations 28 are preferably comprised of mono-material, blends, alloys, and/or co-polymers of: polyethylene (high, medium, low, linear low, and/or ultra low density polymers); polypropylene (oriented and/or biaxially oriented); ethylene vinyl acetate; nylon (oriented and/or biaxially oriented); thermoplastic polyesters; polycarbonate; acrylics; and/or polystyrene. The fastener 24, including the profiles 34 and 36, the fins 38, 40, 46, and 48, and the fin extensions 50 and 52, are preferably comprised of mono-layer, blends, alloys, coextrusions, laminations and/or coatings of: polyethylene (high, medium, low, linear low, and/or ultra low density polymers including metallocene); polypropylene (oriented and/or biaxially oriented); ethylene vinyl acetate; nylon (oriented and/or biaxially oriented); polyethylene terephthalate (oriented and/or biaxially oriented); polyvinyl chloride; ethylene vinyl alcohol (EVOH); polyvinylidene chloride (PVDC); polyvinyl alcohol (PVOH); polystyrene; foil and/or metalization; and paper. The sealant ribs 54 are preferably comprised of mono-material, blends, and/or coextrusions of: polyethylene (low, linear low, and/or ultra low density polymers including metallocene); ethylene vinyl acetate, adhesive or low melting temperature sealant.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A fastener for a top-filled tamper-evident reclosable plastic package, said package including first and second opposing panels joined along a pair of sides and a bottom bridging said sides, said fastener comprising:

first and second opposing tracks along a top of said package, said first and second tracks including respective first and second profiles and respective first and second fins extending from said respective first and second profiles, said first fin being attached to said first panel, said first and second profiles adapted to interlock with each other, said first and second fins being joined to each other at their respective lower ends;

a third fin extending from said second track and disposed generally alongside said second fin, said third fin initially being at least partially unattached to said second panel while said first fin is attached to said first panel so as to allow said package to be filled with a product via a fill opening between said third fin and said second panel; and a preferential area of weakness disposed along at least one of said first and second fins.

2. The fastener of claim 1, wherein said first and second fins are detachably joined to each other along said preferential area of weakness.

3. The fastener of claim 1, wherein said third fin extends from said second profile.

4. The fastener of claim 1, further including a plurality of lower-temperature sealant ribs along said third fin and disposed between said third fin and said second panel.

5. The fastener of claim 1, wherein said third fin is adapted to attach to said second panel to seal said fill opening after said package is filled with the product.

6. A fastener for a top-filled tamper-evident reclosable plastic package, said package including first and second opposing panels joined along a pair of sides and a bottom bridging said sides, said fastener comprising:

first and second opposing tracks along a top of said package, said first and second tracks including respective first and second profiles and respective first and second fins extending from said respective first and second profiles, said first and second profiles adapted to interlock with each other, said first and second fins being joined to each other at their respective lower ends;

third and fourth fins extending from said respective first and second tracks and disposed generally alongside said respective first and second fins, said third fin being attached to said first panel, said fourth fin initially being at least partially unattached to said second panel while said third fin is attached to said first panel so as to allow said package to be filled with a product via a fill opening between said fourth fin and said second panel; and a preferential area of weakness disposed along at least one of said first and second fins.

7. The fastener of claim 6, wherein said first and second fins are detachably joined to each other along said preferential area of weakness.

8. The fastener of claim 6, wherein said third and fourth fins extend from said respective first and second profiles.

9. The fastener of claim 6, further including a plurality of lower-temperature sealant ribs along said fourth fin and disposed between said fourth fin and said second panel.

10. The fastener of claim 6, wherein said fourth fin is adapted to attach to said second panel to seal said fill opening after said package is filled with the product.

11. A fastener for a top-filled tamper-evident reclosable plastic package, said package including first and second opposing panels joined along a pair of sides and a bottom bridging said sides, said fastener comprising:

first and second opposing tracks along a top of said package, said first and second tracks including respective first and second profiles and respective first and second fins extending from said respective first and second profiles, said first fin being attached to said first panel, said first and second profiles adapted to interlock with each other, said first and second fins being joined to each other at their respective lower ends;

a fin extension extending from the lower end of said second fin, said second fin and said fin extension initially being at least partially unattached to said second panel while said first fin is attached to said first panel so as to allow said package to be filled with a product via a fill opening between said fastener and said second panel; and a preferential area of weakness disposed along said first fin.

12. The fastener of claim 11, wherein said second fin and said fin extension are thicker than said first fin.

13. The fastener of claim 11, wherein said preferential area of weakness is disposed proximate the lower end of said first fin.

14. The fastener of claim 11, wherein said first fin, said second fin, and said fin extension define a "Y" cross-sectional configuration.

15. The fastener of claim 11, further including a plurality of lower-temperature sealant ribs along said fin extension and disposed between said fin extension and said second panel.

16. The fastener of claim 11, wherein said fin extension is adapted to attach to said second panel to seal said fill opening after said package is filled with the product.

17. A fastener for a top-filled tamper-evident reclosable plastic package, said package including first and second opposing panels joined along a pair of sides and a bottom bridging said sides, said fastener comprising:

first and second opposing tracks along a top of said package, said first and second tracks including respective first and second profiles and respective first and second fins extending from said respective first and second profiles, said first fin being attached to said first panel, said first and second profiles adapted to interlock with each other, said first and second fins being joined to each other at their respective lower ends;

first and second fin extensions extending from the lower ends of said respective first and second fins, said second fin and said second fin extension initially being at least partially unattached to said second panel while said first fin is attached to said first panel so as to allow said package to be filled with a product via a fill opening between said fastener and said second panel; and a preferential area of weakness disposed along said first fin.

18. The fastener of claim 17, wherein said preferential area of weakness is disposed proximate the lower end of said first fin.

19. The fastener of claim 17, wherein said first and second fins and said first and second fin extensions define an "X" cross-sectional configuration.

20. The fastener of claim 17, wherein said first and second fin extensions are comprised of different materials such that said second fin extension will seal to said second panel at a lower temperature than required to seal said first fin extension to said first panel.

21. The fastener of claim 17, further including a plurality of lower-temperature sealant ribs along said second fin extension and disposed between said second fin extension and said second panel.

22. The fastener of claim 17, wherein said second fin extension is adapted to attach to said second panel to seal said fill opening after said package is filled with the product.

* * * * *